US011430622B2

(12) United States Patent
Edvardsen et al.

(10) Patent No.: US 11,430,622 B2
(45) Date of Patent: Aug. 30, 2022

(54) INTERRUPTER ASSEMBLY

(71) Applicant: ABB Schweiz AG, Baden (CH)

(72) Inventors: Lars Edvardsen, Larvik (NO); Robert Espeseth, Skien (NO); Pål Skryten, Skien (NO); Ganesh Shetiya, Skien (NO)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/147,301

(22) Filed: Jan. 12, 2021

(65) Prior Publication Data

US 2021/0217567 A1 Jul. 15, 2021

(30) Foreign Application Priority Data

Jan. 15, 2020 (EP) ..... 20152031

(51) Int. Cl.

| | |
|---|---|
| ***H01H 33/02*** | (2006.01) |
| ***H01H 33/42*** | (2006.01) |
| ***H01H 33/662*** | (2006.01) |
| ***H01H 33/70*** | (2006.01) |

(52) U.S. Cl.

CPC ..... *H01H 33/42* (2013.01); *H01H 33/022* (2013.01); *H01H 33/66207* (2013.01); *H01H 33/70* (2013.01); *H01H 2033/426* (2013.01)

(58) Field of Classification Search

CPC ..... H01H 33/42; H01H 33/022; H01H 33/66207; H01H 33/666; H01H 33/70; H01H 33/66; H01H 2033/426; H01H 3/46

USPC ..... 218/5, 50, 42, 118, 120, 140, 153, 154, 218/152, 7

See application file for complete search history.

(56) References Cited

U.S. PATENT DOCUMENTS

| | | | | |
|---|---|---|---|---|
| 6,255,615 | B1 | 7/2001 | Kimblin | |
| 6,759,617 | B2 * | 7/2004 | Yoon | H01H 33/666 218/153 |
| 8,629,366 | B2 * | 1/2014 | Reuber | H01H 33/66207 218/44 |
| 8,642,912 | B2 * | 2/2014 | Lee | H01H 33/022 218/120 |
| 9,082,561 | B2 * | 7/2015 | Reuber | H01H 15/00 |
| 9,251,972 | B2 * | 2/2016 | Belloni | H01H 33/6661 |
| 10,381,179 | B2 * | 8/2019 | Sauer | H01H 33/565 |
| 2007/0228014 | A1 * | 10/2007 | Tsuchiya | H01H 33/66207 218/118 |
| 2013/0008765 | A1 * | 1/2013 | Gentsch | H01H 33/666 200/293 |
| 2015/0332883 | A1 * | 11/2015 | Benke | H01H 33/6662 335/9 |
| 2017/0358412 | A1 * | 12/2017 | Delpozza | H01H 50/56 |
| 2019/0287750 | A1 * | 9/2019 | Ren | H02B 13/045 |

FOREIGN PATENT DOCUMENTS

| | | | |
|---|---|---|---|
| DE | 19716956 | A1 | 10/1998 |
| WO | 2017162405 | A1 | 9/2017 |

OTHER PUBLICATIONS

European Search Report; Application No. 20152031.9; dated Jun. 2, 2020; 5 pages.

* cited by examiner

*Primary Examiner* — William A Bolton
(74) *Attorney, Agent, or Firm* — Whitmyer IP Group LLC

(57) ABSTRACT

It is provided an interrupter assembly for power distribution systems that is improved in terms of at least one of compactness, durability, synchronicity and dielectric withstand.

20 Claims, 3 Drawing Sheets

INTERRUPTER ASSEMBLY

TECHNICAL FIELD

Aspects of the invention relate to an interrupter assembly for power distribution systems.

BACKGROUND

Switchgears are used in electric power systems with the purpose to control, protect and isolate electric equipment. In distribution nets, switchgears are located both on the high voltage side and the low voltage side of power transformers.

The field of this disclosure relates to actuation mechanism for opening/closing switchgear such as circuit breakers for high- and medium-voltage transmission and/or distribution networks.

A circuit breaker typically includes a pole assembly having, for each phase, a fixed contact and a movable contact. This latter is typically movable between a first position, in which it is coupled to the fixed contact, and a second position, in which it is uncoupled from said fixed contact, thereby realizing the opening and closing operation of the circuit breaker.

Typically, there is limited room inside the compartment of a switchgear or circuit breaker, e.g. a gas insulated switchgear. The available space inside switchgears or circuit breakers must not only contain all the necessary components, such as the actuation assembly for actuating, for example, the movable contacts of the circuit breakers, but at the same time fulfil dielectric requirements.

Accordingly, there is a challenge of providing an actuation assembly that is compact, e.g. fitting inside a compartment of a switchgear, whilst fulfilling dielectric requirements. There is also be a challenge of improving durability, e.g., in terms of mechanical wear and tear, whilst fulfilling dielectric requirements. There is also be a challenge of improving synchronicity between phases/poles, e.g., during closing and opening operations, whilst fulfilling dielectric requirements.

SUMMARY

In view of the above, an interrupter assembly according to claim 1 is provided.

According to an aspect, there is provided an interrupter assembly for power distribution systems, the interrupter assembly having a drive lever, a linking rod, and an interrupter unit, wherein the interrupter unit having a movable contact and a stationary contact, the movable contact having a stem and being movable along an axis of the movable contact; wherein the drive lever is adapted for being driven by the linking rod to drive the stem for moving the movable contact, wherein the linking rod is connected to the drive lever via a linking connection allowing at least a rotation of the linking rod relative to the drive lever, wherein the drive lever is connected to the stem via a stem connection allowing at least a rotation of the drive lever relative to the stem, wherein the drive lever is mounted via a revolute joint, the revolute joint allowing a rotation of the drive lever for transmitting a movement of the linking rod to a movement of the stem wherein a rotation axis of the linking connection, a rotation axis of the revolute joint, and a rotation axis of the stem connection are parallel to each other, wherein the linking connection is arranged in an axially intermediate location between the stem connection and the stationary contact, and wherein the axially intermediate location is defined along the axis of the movable contact.

Accordingly, the interrupter assembly is improved in terms of at least one, beneficially more than one, of compactness, durability, synchronicity and dielectric withstand.

Further advantages, features, aspects and details that can be combined with embodiments described herein are evident from the dependent claims, the description and the drawings.

BRIEF DESCRIPTION OF THE DRAWINGS

The details will be described in the following with reference to the figures, wherein.

DETAILED DESCRIPTION

Reference will now be made in detail to the various embodiments, one or more examples of which are illustrated in each figure. Each example is provided by way of explanation and is not meant as a limitation. For example, features illustrated or described as part of one embodiment can be used on or in conjunction with any other embodiment to yield yet a further embodiment. It is intended that the present disclosure includes such modifications and variations.

Within the following description of the drawings, the same reference numbers refer to the same or to similar components. Generally, only the differences with respect to the individual embodiments are described. Unless specified otherwise, the description of a part or aspect in one embodiment applies to a corresponding part or aspect in another embodiment as well.

The reference numbers used in the figures are merely for illustration. The aspects described herein are not limited to any particular embodiment. Instead, any aspect described herein can be combined with any other aspect(s) or embodiment(s) described herein unless specified otherwise.

According to aspects or embodiments described herein, an interrupter assembly is optimised in terms of at least one of size, dielectric withstand, and operating lifespan.

Figure 1:
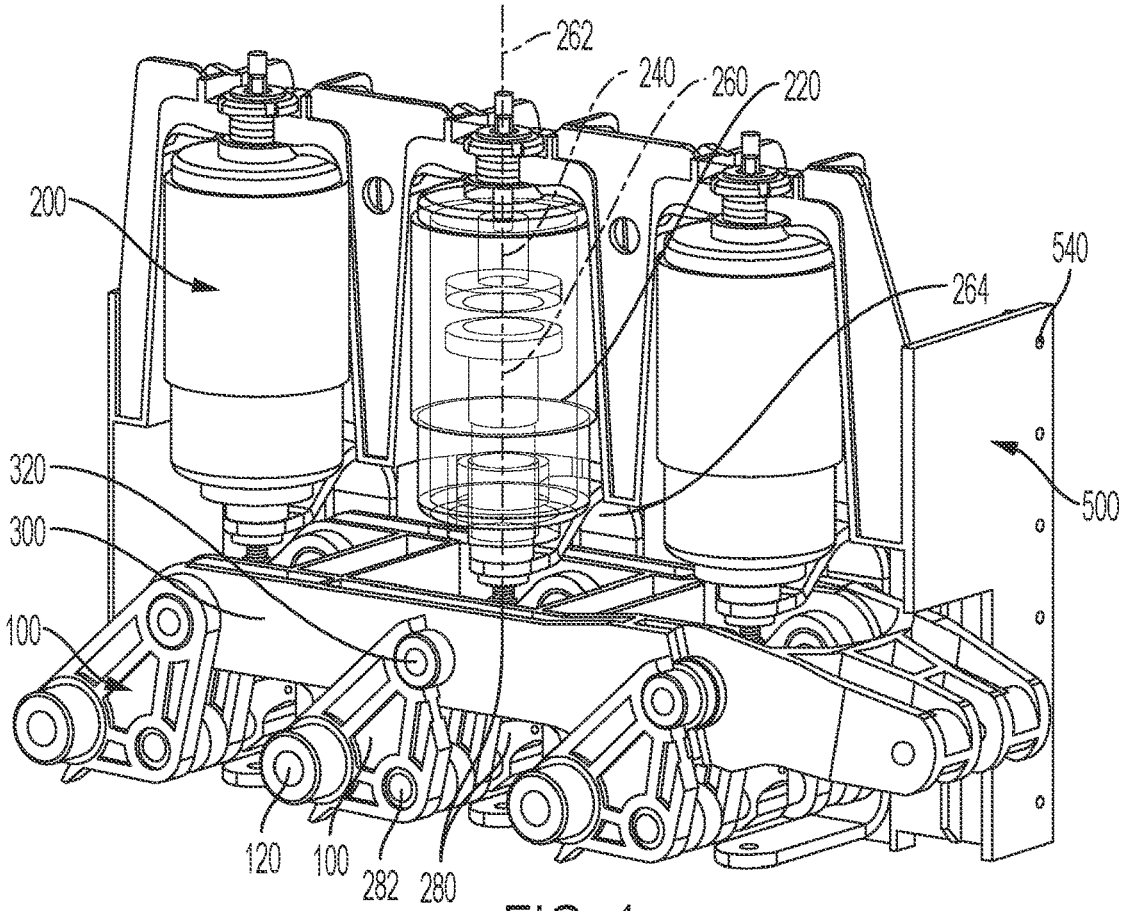
FIG. 1 shows an interrupter assembly according to embodiments described herein.
Figure 2:
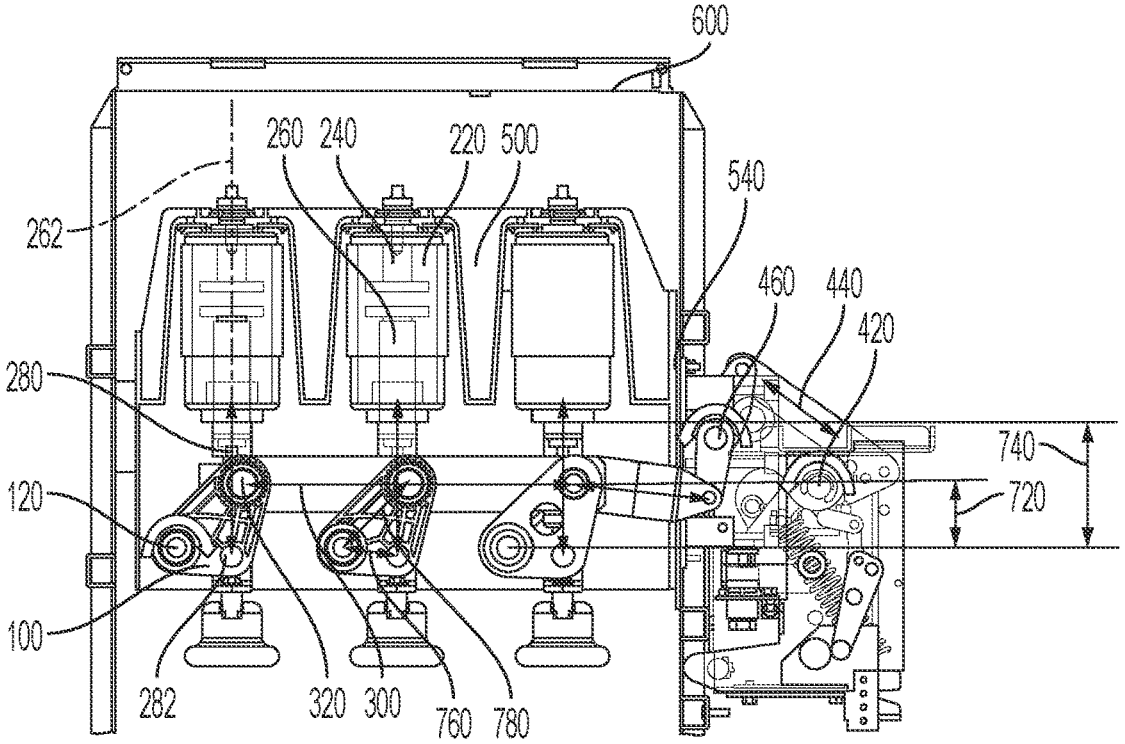
FIG. 2 shows an interrupter assembly according to embodiments described herein.

FIG. 1 and FIG. 2 each show an interrupter assembly according to embodiments described herein. The interrupter assembly may be for power distribution systems. In an example, the interrupter assembly may be suitable for use as a switchgear.

Embodiments and examples for providing a compact kinematic chain are described herein.

Limited room inside the enclosure 600, e.g. gas compartment, makes it difficult to fulfil the dielectric requirements for compact switchgears. Moving or actuating components built around the pushrod(s) of the interrupter(s) minimises the total height of the assembly and provides a compact mechanical operating system (kinematic chain).

Interrupters are typically built with pushrods and actuating components under the main parts of the interrupters. Therefore, it is advantageous that the actuation of the interrupters (poles) is done by means of drive lever(s), e.g., triangular components, that transform horizontal drive movements to vertical actuation.

The drive lever(s) may pivot around a shaft in the lower part of the assembly and may carry the static/dynamic load from the pushrods. The drive lever(s) may be linked together with a horizontally moving traverse, which may fit in the space available around the stem of the movable contact, e.g., pushrods of each of the poles.

Advantageously, the assembly, e.g., interrupter unit 200, which includes for example the stem 280, has a low total height.

The interrupter assembly includes an interrupter unit 200. The interrupter assembly may include a plurality of interrupter units.

For example, the interrupter assembly may include three interrupter units, e.g., a first interrupter unit 200, a second interrupter unit and a third interrupter unit for three phase power.

Accordingly, the interrupter assembly may include a first drive lever 100 for the first interrupter unit 200, a second drive lever for the second interrupter unit, and a third drive lever the third interrupter unit.

The plurality of interrupter units may be arranged in a line, for example, in a line parallel to an axis of the of a linking rod 300.

Accordingly, the interrupter assembly may be configured for a three-phase power distribution system.

For example, one interrupter unit is provided for each phase of a power distribution system.

The interrupter assembly includes an interrupter unit 200. The interrupter unit 200 includes a stationary contact 240 and a movable contact 260.

The interrupter unit 200 may include an interrupter casing 220. The interrupter casing 220 may be of a ceramic material and/or glass material. The interrupter casing 220 may be hermetically sealed or configured to be hermetically sealed. The interrupter casing 220 may be impermeable to gas.

The movable contact 260 may be movable along an axis of the movable contact 262. In a closed state of the interrupter unit 200, the movable contact 260 is in a position contacting the stationary contact 240. In an open state of the interrupter unit 200, the movable contact 260 is separated from the stationary contact 240. The movable contact 260 may be electrically connected to a terminal via a flex conductor 264.

The interrupter assembly includes a drive lever 100.

The drive lever 100 may include a revolute joint 120. The drive lever 100 may be mounted via the revolute joint 120, e.g. to a housing 500. In an example, the revolute joint 120 may include a shaft. The revolute joint 120 may allow a rotation of the drive lever 100, e.g., about the revolute joint 120 or a shaft of the revolute joint 120.

The drive lever 100 may be configured to be rotatable about the revolute joint 120. The drive lever 100 may be configured for transmitting a movement of the linking rod 300 to a movement of the stem 280.

Accordingly, the drive lever 100 may be mounted via a revolute joint 120, the revolute joint 120 allowing a rotation of the drive lever 100 for transmitting a movement of the linking rod 300 to a movement of the stem 280.

A plurality of drive levers may be provided for each interrupter unit 200. FIG. 1 illustrates an example where four (or two pairs of) drive levers are provided for each interrupter unit 200. The drive levers may be rigidly connected together. The drive levers may be parallel to each other. The drive levers may be arranged at a distance from each other. The drive levers may be configured as a pair, e.g., mirrored, or as three or more.

The interrupter assembly includes a linking rod 300.

The driver lever 100 may be connected to the linking rod 300, for example, via a linking connection 320. The linking connection 320 may allow the linking rod 300 to rotate relative to the drive lever 100. In an example, the linking connection 320 may be a revolute-type joint. Accordingly, the linking rod 300 may be connected to the drive lever via a linking connection 320 allowing at least a rotation of the linking rod 300 relative to the drive lever 100.

The drive lever 100 may be configured to be driven by the linking rod 300. For example, the linking connection 320 is configured to cause the drive lever 100 to rotate about the revolute joint 120, when the linking rod 300 is moved. The movement of the linking rod 300 may be a substantially horizontal movement, for example the horizontal component of the movement is more than 50%, beneficially more than 60%, more beneficially more than 80%, or even more beneficially more than 90%, of the total magnitude of the movement.

The drive lever 100 may be connected to a source of actuation energy (not shown). For example, the drive lever 100 may be connected to the source of actuation energy via the linking rod 300.

A source of actuation energy for actuating the movable contact 260 may be provided. Energy may be transferred between the source of actuation energy via a primary actuation shaft 420, transfer link 440, and/or secondary actuation shaft 460. The source of actuation energy, primary actuation shaft 420, transfer link 440, and/or secondary actuation shaft 460 may be arranged outside the enclosure 600.

Embodiments of the drive lever 100 are described herein.

A first axial length 720 may be defined as an axial length between the linking connection 320 and the revolute joint 120. A second axial length 740 may be defined as an axial length of the stem 280 extending outside an interrupter casing 220 when the interrupter unit 200 is in a closed state. Furthermore, an axial length may be defined as a length along the axis of the movable contact 262, for example along a line parallel to the axis of the movable contact 262.

The drive lever 100 may be configured, e.g., in its arrangement and geometry, such that the first axial length 720 is at least half of the second axial length 740. For example, the stem connection 282 and/or linking connection 320 may be arranged such that the first axial length 720 is at least half of the second axial length 740. Accordingly, the force required to the drive the drive lever 100 is reduced.

Alternatively, or additionally, the drive lever 100 may be configured, e.g., in its arrangement and geometry, such that the first axial length 720 is less than the second axial length 740. For example, the stem connection 282 and/or linking connection 320 may be arranged such that the first axial length is at least half of the second axial length 740. Accordingly, the movement of the linking rod 300 required to drive the drive lever 100 is reduced.

Further embodiments of the drive lever 100 are described herein.

A first drive lever length 760 may be defined as a length from the stem connection 282 to the revolute joint 120. A second drive lever length 780 may be defined as a length from the linking connection 320 to the revolute joint 120. Furthermore, a first drive lever length 760 and/or second drive lever length 780 may be defined as a length perpendicular to the axis of the revolute joint 120.

The drive lever 100 may be configured, e.g., in its arrangement and geometry, such that the first drive lever length 760 is less than a second drive lever length 780. For example, the stem connection 282 and/or revolute joint 120 may be arranged such that the first drive lever length 760 is at less than the second drive lever length 780. Accordingly, the force required to drive the stem connection 282 and/or the connected stem 280 is reduced. Accordingly, durability and compactness is improved as mechanical stresses/requirements are reduced.

A plurality of functions may be provided by the linking rod 300. For example, the linking rod 300 is formed as a single piece with a plurality of functions. The linking rod 300 may be moulded as one part. The linking rod 300 may be formed of polymer. A single piece multi-function linking rod 300 is stiffer or more rigid than a multi-component structure. A single piece linking rod 300 also makes assembly easier and faster, e.g., as adjustments between parts of a multi-component linking rod is not needed.

The movable contact 260 includes a stem 280.

The drive lever 100 may be connected to the movable contact 260, for example via a stem 280 of the movable contact 260. The drive lever 100 may be connected to the stem 280 via a stem connection 282. The stem connection 282 may allow the stem 280 to rotate relative to the drive lever 100. In an example, the stem connection 282 may be a revolute-type joint. Accordingly, the drive lever 100 may be connected to the stem 280 via a stem connection 282 allowing at least a rotation of the driver lever 100 relative to the stem 280.

The stem connection 282 may be less than 30 degrees from a first line, e.g., when the interrupter unit 200 is in a closed state. Alternatively, the stem connection 282 may be less than 25 degrees from the first line, beneficially less than 20 degrees from the first line, even more beneficially less than 10 degrees, e.g., when the interrupter unit 200 is in a closed state.

Alternatively, the drive lever 100 may be configured, e.g., in its arrangement and geometry, such that the stem connection 282 is at most 30 degrees from the first line. Alternatively, the drive lever 100 may be configured such that the stem connection 282 is beneficially at most 25 degrees, more beneficially at most 20 degrees, even more beneficially at most 15 degrees, and most beneficially at most 10 degrees from the first line.

The first line may be defined as a line passing through the revolute joint 120, e.g., through the centre of the revolute joint 120, being perpendicular to the rotation axis of the revolute joint 120 and being perpendicular to the axis of the movable contact 262. Alternatively, the first line may be a horizontal line, e.g., relative to the direction of gravity or e.g., when the axis of the movable contact 262 is a vertical line.

The angle of the stem connection 282 with the first line may be defined as in an angular direction towards the stationary contact 240 or in an angular direction towards the linking connection 320.

Accordingly, the lateral movement, e.g., movement not parallel to the axis of the movable contact 262, of the stem 280 and/or movable contact 260 is advantageously small.

The drive lever 100 may be configured to drive the stem 280. For example, the stem connection 282 is configured to cause the stem 280 to move when the drive lever 100 is rotated. The movement of the stem 280 may be a substantially vertical movement, for example the vertical component of the movement is more than 50%, beneficially more than 60%, more beneficially more than 80%, or even more beneficially more than 90%, of the total magnitude of the movement.

The drive lever 100 may be configured for being driven by the linking rod 300 to drive the stem 280 for moving the movable contact 260.

The drive lever 100 may be configured to transform a horizontal movement from a source of actuation energy (not shown), e.g., a spring mechanism, to a vertical actuation of the interrupter unit 200 or to a movement of the movable contact 260. Accordingly, the movable contact 260 of the interrupter assembly can be actuated by a source of actuation energy.

As can be appreciated, there is more than one possible arrangement of the position of the drive lever 100, as well as the positions of the linking connection 320 and the stem connection 282 on the drive lever 100 for transforming a substantially horizontal movement of the linking rod 300 to a substantially vertical movement of the stem 280.

In an example, the positions of the revolute joint 120, linking connection 320 and stem connection 282 on the drive lever 100 is arranged to form a triangular shape.

In another example, the drive lever 100 may be mirrored, e.g., sideways, for example the revolute joint 120 is arranged across the axis of the movable contact 262. In this case, the movement of the linking rod 300 is reversed for closing and opening the interrupter unit 200.

The drive lever 100 may be arranged around the movable contact 260, e.g., around the stem 280 of the movable contact 260.

The linking connection 320 may be arranged in an axially intermediate location between the stem connection 282 and the stationary contact 240. The linking rod 300 may be arranged in an axially intermediate location between the stem connection 282 and the stationary contact 240. An axially intermediate location may be defined along the axis of the movable contact 262, for example along a line parallel to the axis of the movable contact 262.

Alternatively, or in addition, the linking connection 320 may be arranged in an axially intermediate location between the revolute joint 120 and the stationary contact 240. The linking rod 300 may be arranged in an axially intermediate location between the revolute joint 120 and the stationary contact 240. An axially intermediate location may be defined along the axis of the movable contact 262, for example along a line parallel to the axis of the movable contact 262.

Alternatively, or in addition, at least one from a group including the linking rod 300, linking connection 320, drive lever 100, revolute joint 120, and stem connection 282, is/are arranged in an axially intermediate location(s) between a bottom end portion of the stem 280 and the stationary contact 240, e.g., when the interrupter unit 200 is in an open state. A bottom end portion of the stem 280 is an end portion of the stem 280 that is furthest from the point(s) of the movable contact 260 that makes contact with the stationary contact 240, or an end portion of the stem 280 that is furthest from the stationary contact 240, or an end portion of the stem 280 that is outside of the interrupter casing 220.

Alternatively, or in addition, the stem connection 282 on the drive lever 100 (or a portion of the drive lever 100 that is connected to the stem 280) may be the portion of the drive lever 100 that is the furthest from the stationary contact 240, e.g., when the interrupter unit 200 is in an open state.

Alternatively, or in addition, the revolute joint 120 of the drive lever 100 may be the portion of the drive lever 100 that is furthest from the stationary contact 240, e.g. when the interrupter unit 200 is in an open state.

Accordingly, the height of the interrupter assembly is low and the interrupter assembly can be made compact.

Embodiments and examples for an energy efficient kinematic chain are described herein.

A whole system of moving mechanical parts may be designed so that all force vectors act along or parallel to the one and same plane. Accordingly, the effective utilisation of energy in the mechanical drive for opening and closing the interrupter unit 200 is increased and energy loss reduced.

Mechanical drive may be supplied with source of actuation energy, e.g., high energy springs, that is stronger than necessary, in order to open or close the interrupter unit 200 with a safety margin.

Energy losses, for example from friction, in the kinematic chain between the source of actuation energy (not shown), e.g., drive spring, and the stem 280 of the movable contact 260, e.g., a pushrod spring pack, can be a reason for having the safety margin. Additionally, different transfer links acting at various angle and direction to each other can consume energy.

Having a stronger actuation energy source, e.g., stronger drive springs, than needed creates a mechanical endurance challenge, e.g., due to high impacts and shocks in the system. Thus, it is advantageous to have direct linear movement(s), e.g., instead of rotational movements, for example, inside the (gas/gas tight) enclosure 600, in which the whole system of moving mechanical parts may be such that all force vectors act along or parallel to the one and same plane.

In this way, friction loss is reduced and the energy in the mechanical drive, e.g., in a spring powered mechanical drive, is effectively utilised.

The primary plane of force vectors in the mechanical drive may be maintained throughout the kinematic chain. For example, the force may be transferred between a source of actuation energy and the movable contact 260 by linking rod 300 and drive lever 100.

The rotation axis of the revolute joint 120, the rotation axis of the linking connection 320, and the rotation axis of the stem connection 282 may be parallel to each other.

Additionally, a source of actuation energy (not shown), e.g., spring mechanism and/or manual lever (or charging motor) for re-charging a spring mechanism, may be configured to move in a line or plane parallel to the movement plane of at least one from a group including the movable contact 260, stem 280, drive lever 100, and linking rod 300.

In this manner, the movement of the movable contact 260, the operating force of kinematic transfer components such as the stem 280, drive lever 100, linking rod 300, spring (not shown), and/or manual lever (or charging motor) can be made to be parallel to the same plane. Accordingly, (kinetic) energy loss, along the kinematic chain from the source of actuation energy to the movable contact 260, is reduced.

Accordingly, mechanical impacts/shocks during opening and closing operations are reduced and durability improved. Additionally, mechanical demands on mechanical drive components such as linking rod 300, spring(s) (not shown) can be reduced, and compactness improved.

Embodiments and examples relating to an electrically isolating and strong kinematic chain are described herein.

Typically, combinations of both isolating and conductive construction elements are used in breakers, where the conductive construction elements are often chosen for their mechanical properties. Those conductive construction elements addressing a mechanical need, are often disadvantageous dielectrically.

The use of metallic and steel materials ends up most often with a lot of added field controllers of advanced shape to maintain the needed dielectric withstand inside the enclosure 600. Additionally, the stiffness of a multi-component construction is often not good enough to achieve proper synchronicity between the phases.

The use of polymer materials provides advantages for stiffness and dielectric withstand. Polymer materials such as thermosetting plastics also improve/reduce part count in the breaker as a lot of functionality is designed into each component.

Building the load carrying kinematic chain components using strong thermoset polymer materials provides a stiff, rigid and non-conductive construction. Accordingly, cost advantages can be realised, e.g., material cost, reduced part count, field controller not needed. Assembly time is also advantageously reduced because of reduced part count. Dielectric withstand is improved by use of polymer materials. Compactness is improved, since polymer kinematic chain, such as polymer linking rod 300, improves dielectric withstand allowing a more compact arrangement.

Building the entire load carrying kinematic chain, e.g., driver lever 100 and linking rod 300, using strong thermoset polymer materials advantageously provides a stiff, rigid and non-conductive construction. In an example, the drive lever 100 and/or the linking rod 300 is/are of a polymer material.

The polymer e.g., thermoset material, used may advantageously be of a high elastic modulus for stiffness, low warpage and/or post shrinkage after manufacturing. The polymer material used may be thermally stable, low cost and/or cross-linked molecular structure.

In an example, the polymer, e.g., thermoset material may have an elastic modulus of at least 1500 $N/mm^2$, beneficially, at least 3000 $N/mm^2$, more beneficially, at least 5000 $N/mm^2$, most beneficially, at least 10000 $N/mm^2$. Accordingly, a stiff construction is achieved and synchronicity is improved.

In an example, the polymer, e.g., thermoset material may have a tensile strength of at least 20 $N/mm^2$, beneficially, at least 30 $N/mm^2$, more beneficially, at least 50 $N/mm^2$, most beneficially, at least 65 $N/mm^2$. Accordingly, a strong construction is achieved and compactness is improved.

In an example, the polymer, e.g., thermoset material may have a shrinking (when moulding) of at most 2%, beneficially, at most 1%, more beneficially, at most 0.5%, most beneficially, at most 0.12%. Accordingly, residual stress is reduced, thus mechanical integrity/strength improved, thus compactness improved. Also, assembly tolerance is improved, thus close-fitting assembly improved, thus stiffness improved.

In an example, polymers with 20% to 70% glass fibre reinforcement may be used. Polyester or epoxy may be used as a matrix material. Matrix material may have cross-linked molecular structure.

Alternative to thermoset material, or in addition to thermoset material, (high-performance) thermoplastic polymer, such as glass-fibre reinforced polycarbonate (PC) or polybutylene terephthalate (PBT) may be used.

Accordingly, advantages such as multi-function parts for reduced part count for improved stiffness for improved synchronicity and compact interrupter assembly, as well as improved dielectric property for improved dielectric withstand for compact interrupter assembly are provided.

Polymer materials can be used to manufacture components such as linking rod 300 and drive lever 100 by means of compression moulding, injection moulding, and/or pultrusion of profiles.

Embodiments of the interrupter unit is described herein.

The interrupter unit 200 may be mounted in either a gas insulated breaker or an air insulated breaker. For example, the enclosure 600 may be configured for containing a gas insulation or air insulation.

The interrupter unit 200 may be a vacuum interrupter. For example, the interrupter unit 200 may include an interrupter casing 220 for containing a vacuum. Accordingly, the interrupter unit 200 may be suitable for circuit breakers and/or a higher (relative to puffer-type) voltage rating.

Alternatively, the interrupter unit 200 may be a puffer-type switch. For example, the interrupter unit 200 may include an interrupter casing 220 for containing insulating gas or air. Accordingly, the interrupter unit 200 may be suitable for load breakers and/or a lower (relative to vacuum) voltage rating.

Embodiments and examples relating to non-conductive wear elements are described herein.

Load carrying construction elements are often of steel and/or metallic material, with advantageous mechanical properties but disadvantageous dielectric properties in medium-voltage and high-voltage applications.

Additionally, from mechanical endurance testing, wear elements such as bearings and couplings made of conductive elements such as steel, copper and bronze can produce conductive particles. Conductive particles in the enclosure 600, e.g., gas compartment, produces adverse effects in terms of dielectric withstand.

Wear resistance may be improved. Alternatively, or additionally, wear elements, e.g., in moving parts, using polymer materials, is beneficial. More beneficially, is the use of polymer wear elements in dielectrically critical locations.

In an example, the revolute joint 120 and/or the linking connection 320 may be of a polymer material. For example, the polymer bearing(s) may be used in the revolute joint 120 and/or the linking connection 320. Accordingly, no conductive particles are produced, e.g., in the enclosure 600 and dielectric withstand is improved.

The bearing unit and/or shaft of the stem connection 282, which may be on a lower part of the stem 280, e.g., at an end portion of the stem 280, may be of a metal e.g. bronze. The stem 280 may be also metal, e.g., copper, steel, or bronze. The stem 280 and/or stem connection 282 may be conductive because it/they may be electrically shielded by the relatively larger interrupter unit 200, e.g., by the movable contact 260 of the interrupter unit 200. Accordingly, cost-effective mechanical robustness is provided.

Furthermore, polymer wear elements, e.g., polymer bearings, are advantageous in terms of cost and wear resistance. From wear resistance tests, with ten thousand operations with higher mechanical load than expected during normal operation, shows no measurable wear and outstanding mechanical performance.

Accordingly, the use of polymer materials in wear elements such as in the revolute joint 120, and/or linking connection 320 is advantageous in terms of structural integrity, electrical insulation and mechanical performance.

Furthermore, wear elements of the housing 500, e.g., load carrying shafts or anchoring interfaces may also be of polymer material. Anchoring interfaces include the interrupter anchoring interface 510, drive lever anchoring interface 520, flex conductor anchoring interface 530, and enclosure anchoring interface 540.

Figure 3A:
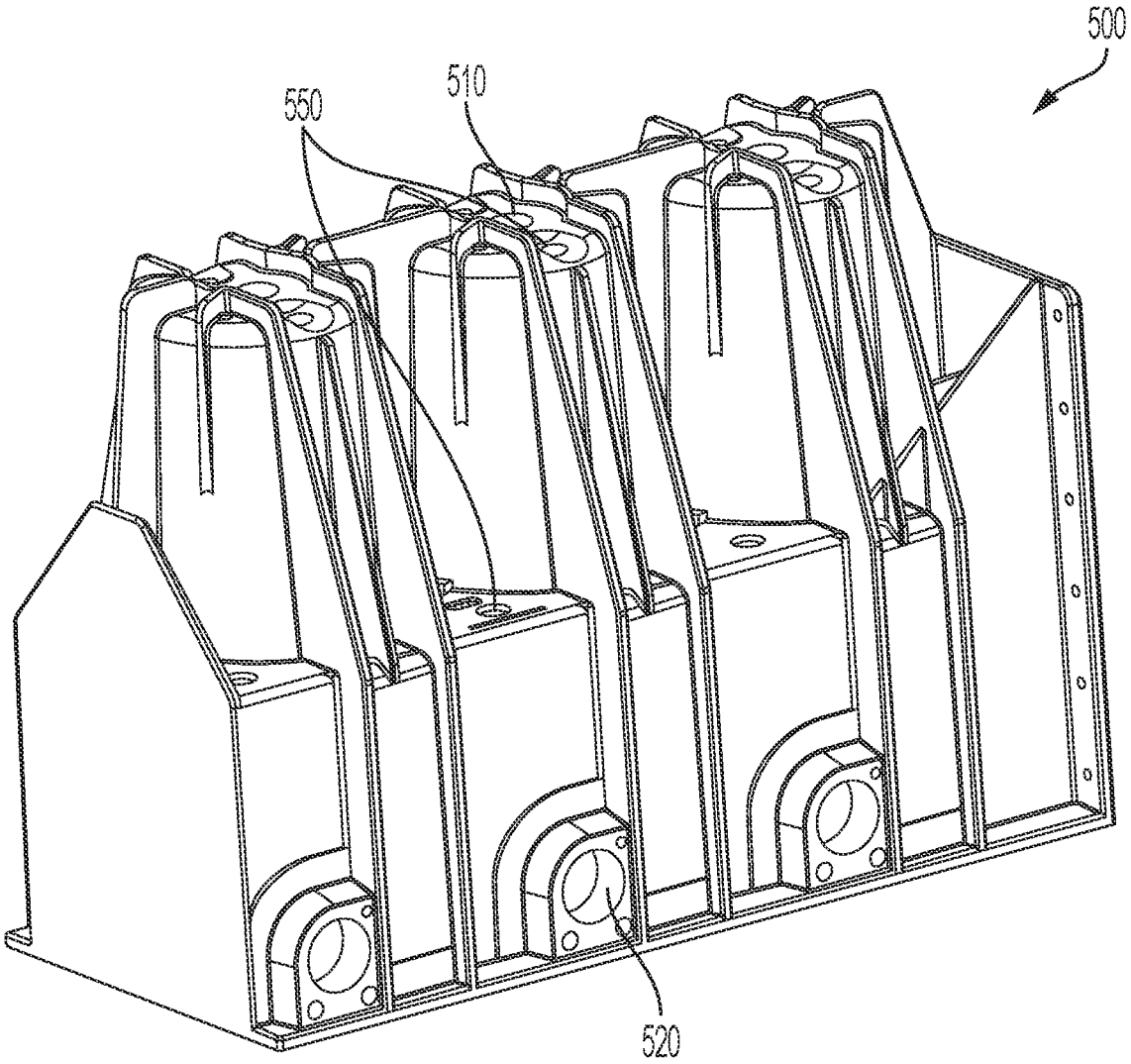
FIG. 3A shows a housing according to embodiments described herein.
Figure 3B:
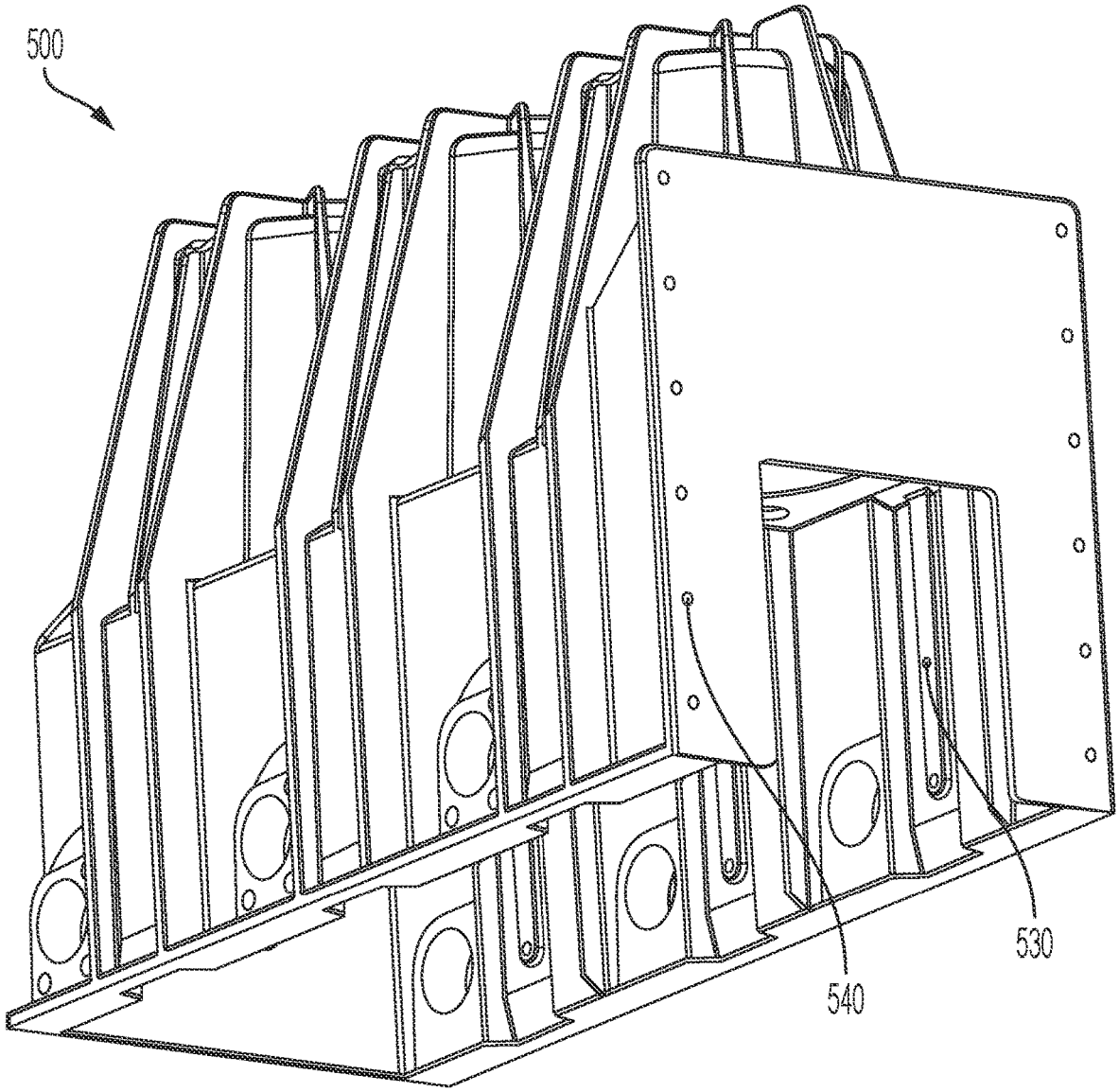
FIG. 3B shows a housing according to embodiments described herein.

FIG. 3A and FIG. 3B each show a housing according to embodiments described herein.

Housing structures may be a number of interfaces for anchoring various components and for anchoring to the enclosure 600 enclosing the interrupter assembly. Accordingly, housing structures typically include a number of different parts to be assembled. A large number of parts makes assembly time consuming and complex because of the adjustment of the poles.

Furthermore, housing structures for interrupter assemblies typically carry both static and dynamic loads. Accordingly, steel/metallic material with their advantageous mechanical properties but disadvantageous dielectric properties are typically used.

The interrupter assembly may include a housing 500.

The housing 500 may be a frame or bracket structure. The housing 500 may be configured for housing the interrupter assembly, such as the drive lever 100 and/or at least part of the linking rod 300.

The housing 500 may be manufactured as a single piece. Accordingly, a torsionally stiff construction with low (mechanical) energy absorbance/loss housing is provided.

The housing 500 may be of a polymer material. Accordingly, the housing 500 improves dielectric withstand since metallic fasteners are not needed. Improved dielectric properties also improve compactness of the interrupter assembly.

The housing 500 may include an interrupter unit anchoring interface 510 for anchoring the interrupter unit 200, a driver lever anchoring interface 520 for anchoring the drive lever 100, a flex conductor anchoring interface 530 for anchoring a flex conductor 264, and/or an enclosure anchoring interface 540 for anchoring to the enclosure 600.

The housing 500 may be configured for anchoring elements of the interrupter assembly and/or being anchored to an enclosure 600. For example, the housing 500 is manufactured as a single piece with different anchoring interfaces.

The housing 500 may include at least one ventilation opening 550 for heat dissipation.

Accordingly, stiffness, part count, tolerance chain, assembly, dielectric property, and cost are improved since different functions, e.g., various anchors and ventilation, are simultaneously provided by a single piece polymer housing 500. Better dielectric property also enables a compact interrupter assembly.

Further embodiments are described as follows.

According to embodiment 1, there is provided an interrupter assembly for power distribution systems, the interrupter assembly comprising a drive lever (100), a linking rod (300), and an interrupter unit (200), wherein the interrupter unit (200) comprises a movable contact (260) and a stationary contact (240), the movable contact (260) having a stem (280) and being movable along an axis of the movable contact (262); wherein the drive lever (100) is adapted for being driven by the linking rod (300) to drive the stem (280) for moving the movable contact (260), wherein the linking rod (300) is connected to the drive lever (100) via a linking connection (320) allowing at least a rotation of the linking rod (300) relative to the drive lever (100), wherein the drive lever (100) is connected to the stem (280) via a stem connection (282) allowing at least a rotation of the drive lever (100) relative to the stem (280), wherein the drive lever (100) is mounted via a revolute joint (120), the revolute joint (120) allowing a rotation of the drive lever (100) for transmitting a movement of the linking rod (300) to a movement of the stem (280), wherein a rotation axis of the linking connection (320), a rotation axis of the revolute joint (120), and a rotation axis of the stem connection (282) are parallel to each other, wherein the linking connection (320) is arranged in an axially intermediate location between the stem connection (282) and the stationary contact (240), and wherein the axially intermediate location is defined along the axis of the movable contact (262).

According to embodiment 2, there is provided an interrupter assembly according to embodiment 1, wherein the drive lever (100) is mounted to a housing (500) via the revolute joint (120).

According to embodiment 3, there is provided an interrupter assembly according to any of embodiments 1 to 2, wherein the stem connection (282) is less than 30 degrees from a first line passing through the revolute joint (120) when the interrupter unit (200) is in a closed state, wherein the first line is perpendicular to the rotation axis of the revolute joint (120) and perpendicular to the axis of the movable contact (262).

According to embodiment 4, there is provided an interrupter assembly according to any of embodiments 1 to 3, wherein the interrupter unit (200) is mounted in either a gas insulated breaker or an air insulated breaker.

According to embodiment 5, there is provided an interrupter assembly according to any of embodiments 1 to 4, wherein the interrupter unit (200) is a vacuum interrupter and comprises an interrupter casing (220) for containing a vacuum, or wherein the interrupter unit (200) is a puffer type switch and comprises an interrupter casing (220) for containing insulating gas or air.

According to embodiment 6, there is provided an interrupter assembly according to any of embodiments 1 to 5, wherein the stem connection (282) and/or the linking connection (320) is a revolute-type joint.

According to embodiment 7, there is provided an interrupter assembly according to any of embodiments 1 to 6, wherein a first axial length (720) is at least half of a second axial length (740) and/or the first axial length (720) is less than the second axial length (740), wherein the first axial length (720) is an axial length between the linking connection (320) and the revolute joint (120), wherein the second axial length (740) is an axial length of the stem (280) extending outside an interrupter casing (220) when the interrupter unit (200) is in a closed state, and wherein axial length is a length along the axis of the movable contact (262).

According to embodiment 8, there is provided an interrupter assembly according to any of embodiments 1 to 7, wherein a first drive lever length (760) is less than a second drive lever length (780), wherein the first drive lever length (760) is a length from the stem connection (282) to the revolute joint (120), and wherein the second drive lever length (780) is a length from the linking connection (320) to the revolute joint (120).

According to embodiment 9, there is provided an interrupter assembly according to any of embodiments 1 to 8, further comprising a second interrupter unit and a third interrupter unit, and a second drive lever for the second interrupter unit and a third drive lever the third interrupter unit.

According to embodiment 10, there is provided an interrupter assembly according to any of embodiments 1 to 9, wherein at least one of a group comprising the drive lever (100), the linking rod (300), the revolute joint (120), and the linking connection (320) is/are of a polymer material.

According to embodiment 11, there is provided an interrupter assembly according to any of embodiments 1 to 10, further comprising the housing (500) for housing the interrupter assembly, and optionally for housing at least one from a group comprising the gear lever (100), and at least part of the linking rod (300).

According to embodiment 12, there is provided an interrupter assembly according to embodiment 11, wherein the housing (500) is manufactured as a single piece and/or the housing (500) is of a polymer material.

According to embodiment 13, there is provided an interrupter assembly according to embodiment 11 or embodiment 12, wherein the housing (500) comprises at least one ventilation opening (550).

According to embodiment 14, there is provided an interrupter assembly according to any of embodiments 11 to 13, wherein the housing (500) comprises at least one from a group comprising an interrupter unit anchoring interface (510) for anchoring the interrupter unit (200), a driver lever anchoring interface (520) for anchoring the drive lever (100), a flex conductor anchoring interface (530) for anchoring a flex conductor (264), and an enclosure anchoring interface (540) for anchoring to the enclosure (600).

According to embodiment 15, there is provided an interrupter assembly according to any of embodiments 1 to 14, wherein the interrupter assembly is configured for medium and/or high-voltage power distribution systems.

The invention claimed is:

1. An interrupter assembly for power distribution systems, the interrupter assembly comprising a drive lever, a linking rod, and an interrupter unit, wherein the interrupter unit comprises a movable contact and a stationary contact, the movable contact having a stem and being movable along an axis of the movable contact;

wherein the drive lever is adapted for being driven by the linking rod to drive the stem for moving the movable contact, wherein the linking rod is connected to the drive lever via a linking connection allowing at least a rotation of the linking rod relative to the drive lever, wherein the drive lever is connected to the stem via a stem connection allowing at least a rotation of the drive lever relative to the stem, wherein the drive lever is mounted via a revolute joint, the revolute joint allowing a rotation of the drive lever for transmitting a movement of the linking rod to a movement of the stem, wherein a rotation axis of the linking connection, a rotation axis of the revolute joint, and a rotation axis of the stem connection are parallel to each other, wherein the linking connection is arranged in an axially intermediate location between the stem connection and the stationary contact, and wherein the axially intermediate location is defined along the axis of the movable contact.

2. The interrupter assembly according to claim 1, wherein the drive lever is mounted to a housing via the revolute joint.

3. The interrupter assembly according to claim 2, further comprising the housing for housing the interrupter assembly.

4. The interrupter assembly according to claim 3, wherein at least one of the following applies: the housing is manufactured as a single piece and the housing is of a polymer material.

5. The interrupter assembly according to claim 3, wherein the housing comprises at least one ventilation opening.

6. The interrupter assembly according to claim 3, wherein the housing comprises at least one from a group comprising an interrupter unit anchoring interface for anchoring the interrupter unit, a driver lever anchoring interface for anchoring the drive lever, a flex conductor anchoring interface for anchoring a flex conductor, and an enclosure anchoring interface for anchoring to an enclosure.

7. The interrupter assembly according to claim 3, wherein the housing also houses the drive lever, at least part of the linking rod, or both the drive lever and at least part of the linking rod.

8. The interrupter assembly according to claim 2, wherein the stem connection is less than 30 degrees from a first line passing through the revolute joint when the interrupter unit is in a closed state, wherein the first line is perpendicular to the rotation axis of the revolute joint and perpendicular to the axis of the movable contact.

9. The interrupter assembly according to claim 2, wherein the interrupter unit is mounted in either a gas insulated breaker or an air insulated breaker.

10. The interrupter assembly according to claim 2, wherein the interrupter unit is a vacuum interrupter and comprises an interrupter casing for containing a vacuum, or wherein the interrupter unit is a puffer type switch and comprises an interrupter casing for containing insulating gas or air.

11. The interrupter assembly according to claim 2, wherein at least one of the stem connection and the linking connection is a second revolute joint.

12. The interrupter assembly according to claim 1, wherein the stem connection is less than 30 degrees from a first line passing through the revolute joint when the interrupter unit is in a closed state, wherein the first line is perpendicular to the rotation axis of the revolute joint and perpendicular to the axis of the movable contact.

13. The interrupter assembly according to claim 1, wherein the interrupter unit is mounted in either a gas insulated breaker or an air insulated breaker.

14. The interrupter assembly according to claim 1, wherein the interrupter unit is a vacuum interrupter and comprises an interrupter casing for containing a vacuum, or wherein the interrupter unit is a puffer type switch and comprises an interrupter casing for containing insulating gas or air.

15. The interrupter assembly according to claim 1, wherein at least one of the stem connection and the linking connection is a second revolute joint.

16. The interrupter assembly according to claim 1, wherein at least one of the following applies: a first axial length is at least half of a second axial length and the first axial length is less than the second axial length, wherein the first axial length is an axial length between the linking connection and the revolute joint, wherein the second axial length is an axial length of the stem extending outside an interrupter casing when the interrupter unit is in a closed state, and wherein axial length is a length along the axis of the movable contact.

17. The interrupter assembly according to claim 1, wherein a first drive lever length is less than a second drive lever length, wherein the first drive lever length is a length from the stem connection to the revolute joint, and wherein the second drive lever length is a length from the linking connection to the revolute joint.

18. The interrupter assembly according to claim 1, further comprising a second interrupter unit and a third interrupter unit, and a second drive lever for the second interrupter unit and a third drive lever the third interrupter unit.

19. The interrupter assembly according to claim 1, wherein at least one of a group comprising the drive lever, the linking rod, the revolute joint, and the linking connection is/are of a polymer material.

20. The interrupter assembly according to claim 1, wherein the interrupter assembly is configured for at least one of medium and high-voltage power distribution systems.

* * * * *